US005566519A

United States Patent [19]

Almaraz-Miera

[11] Patent Number: 5,566,519

[45] Date of Patent: Oct. 22, 1996

[54] PREFABRICATED PANEL FOR BUILDINGS AND CONSTRUCTIONS AND SYSTEM FOR ITS COUPLING AND ASSEMBLY

[76] Inventor: Antonio Almaraz-Miera, Esculator Ordoñez 32 - 34 át 1ª, 08016 Barcelona, Spain

[21] Appl. No.: 417,214

[22] Filed: Apr. 5, 1995

[30] Foreign Application Priority Data

Apr. 7, 1994 [ES] Spain ..... 9400787

[51] Int. Cl.[6] ..... E04B 2/08

[52] U.S. Cl. ..... 52/592.1; 52/570; 52/603; 52/426; 52/422

[58] Field of Search ..... 52/592.1, 592.2, 52/789.1, 239, 439, 421–426, 604, 606, 612, 284, 712, 569–572, 783.1, 442

[56] References Cited

U.S. PATENT DOCUMENTS

| | | | |
|---|---|---|---|
| 1,355,580 | 10/1920 | Tyson | 52/423 X |
| 1,877,898 | 9/1932 | Kotrbaty | 52/439 X |
| 2,208,589 | 7/1940 | Leemhuis | 52/274 X |
| 2,770,965 | 11/1956 | Engel | 52/405.1 |
| 3,220,151 | 11/1965 | Goldman | 52/603 X |
| 3,777,431 | 12/1973 | Bowman | 52/604 X |
| 3,788,020 | 1/1974 | Gregori | 52/426 X |
| 4,147,007 | 4/1979 | Eppich | 52/284 X |
| 4,577,447 | 3/1986 | Doran | 52/426 X |
| 5,259,161 | 11/1993 | Carter | 52/442 X |

*Primary Examiner*—Carl D. Friedman
*Assistant Examiner*—Winnie Yip
*Attorney, Agent, or Firm*—Graybeal Jackson Haley & Johnson

[57] ABSTRACT

A prefabricated panel for buildings and constructions adapted to be interconnected by mortise-and-tenon coupling with other panels, comprising on at least one of its faces a series of projections (2, 7) followed by tenon couplings (3, 8) and/or mortise couplings (4, 9) in form of protuberances and recesses, at least one of the walls of said protuberances or recesses being resilient and thus facilitating a snug force fit between them when conveniently opposing the faces of two panels, the height of said projections (2, 7) being such that it determines a separation between the opposite faces of the two panels which forms a hollow chamber. The projections (2, 7) with tenon couplings (3, 8) and the mortise couplings (4, 9) are distributed at such a distance to each other that they offer interstitial gaps (11) through the free hollow space between panels. The interstitial gaps (11) of said hollow chamber allow to arrange therethrough different ductings and wirings in all directions. According to the proposed system several elements (18, 19, 20, 22) are provided for the positioning, fixing and support of said panels at their flanks or perimeter of support or joining on or with the structure of the building or construction.

23 Claims, 8 Drawing Sheets

FIG. 5A
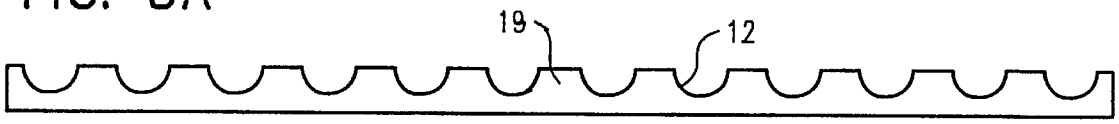
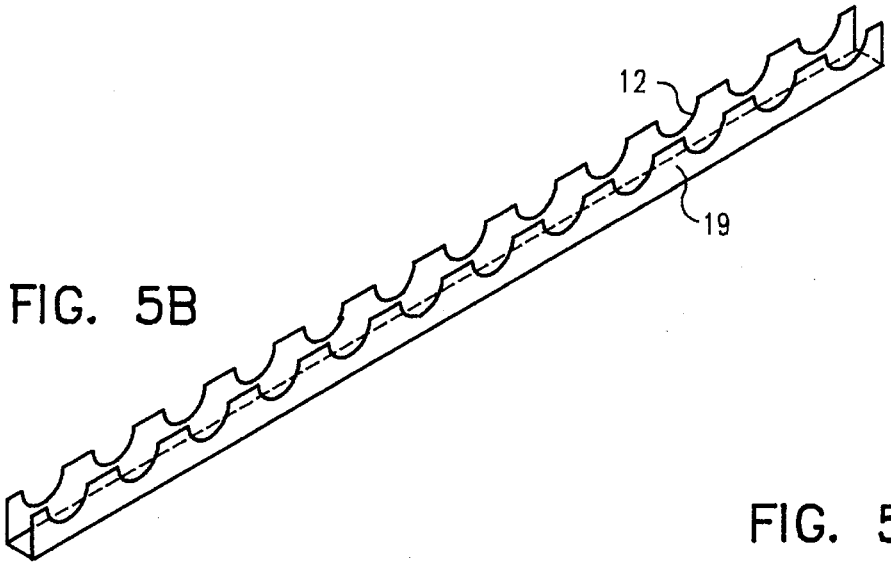
FIG. 5B
FIG. 5C
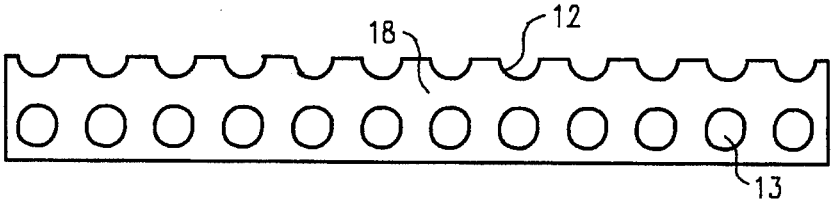
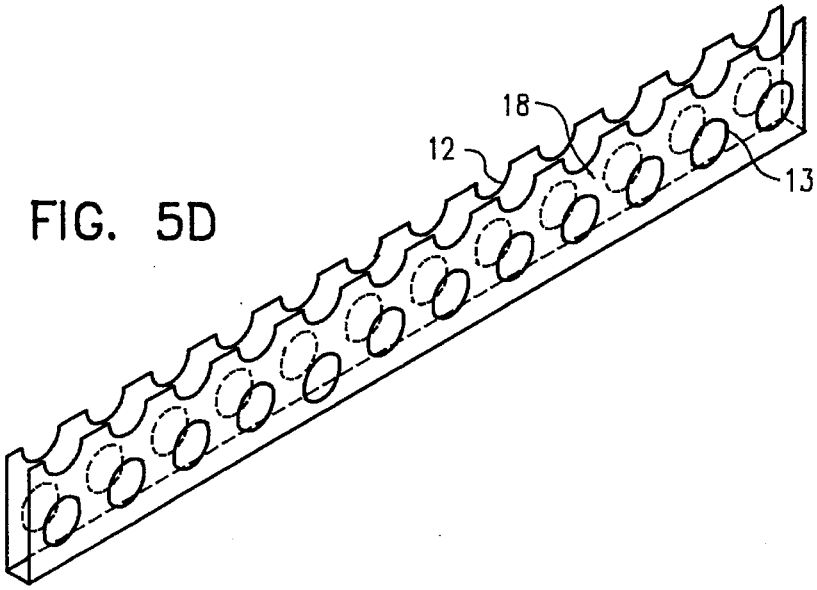
FIG. 5D

PREFABRICATED PANEL FOR BUILDINGS AND CONSTRUCTIONS AND SYSTEM FOR ITS COUPLING AND ASSEMBLY

BACKGROUND OF THE INVENTION

1. Field of the Invention

The present Patent of Invention refers to a prefabricated panel especially provided for its use in building and construction, and to a system for the coupling and assembly of said prefabricated panels.

This system is particularly suitable for the assembly of prefabricated panels in construction.

2. Description of the Prior Art

In traditional construction, the wall is built using easily manipulable prismatic elements (brick, light concrete blocks, etc.) which are either left visible when specially manufactured for this purpose, or else faced with some material or other in order to produce a decorative, impermeable or other kind of desired finish.

Mentioned prismatic elements contain gaps in their interior with the purpose of reducing their weight, improving the adhesive power of the mortar and permitting the passage of installations. Once the wall is built, normally the levels have to be made in which the installations will be embedded and subsequently covered before the surface finish is applied.

The drawback to this traditional construction system lies in the fact that the surface finish must be applied on site, normally with wet means and using some form of relatively artisan method.

Among the most present-day industrialised systems we find:

- those which themselves constitute the partition, with the whole of their bulk filled in for example gypsum plaster plates or slabs in roofs and walls.
- those of homogeneous bulk containing unidirectional hollows.
- those assembled on site on the basis of a compound system of linear structural elements (joint assemblies or frameworks) and flat panelling elements.

The drawback of the first and second industrialised systems is that the facing of the panels must be the same on both sides; on the other hand, in those cases where both sides are different, we have a very limited technological range at our disposal, since two different technologies will have to be applied together to each side of the panel. Furthermore, the change of a panel or part of a panel is made to the detriment of both sides, that is, the partition function is lost during the process.

On the other hand, the fact that the panels consist of a solid bulk or contain unidirectional hollows has a drawback in that the passage of installations is either hindered or must be carried out in established directions, generally after a hollow has been opened in the panel through which to pass the installation.

In systems of framework and plate, one of the drawbacks is that the dimensions of the panels determine the structural arrangement of the framework, and though both may be more or less flexible in their initial layout, once established they remain fixed and any modification at a given point must take these dimensions into account, which leads to drawbacks when the plates are subsequently adjusted. Whatever the case, the framework cannot be so impenetrable so as not to permit small modulations except at considerable extra cost, which would be detrimental to the objective (of reducing execution costs).

Moreover, once the directionality of the panels has been determined (horizontal, vertical or sloping), the ensuing layout cannot easily be modified or interchanged.

As regards the installations, while there are no problems involved in their passage between panels, there may be problems when they are made to pass through the framework elements.

A further drawback is that the modification or substitution of the panel either requires specialised labour or else produces a traumatic effect on the system, normally impeding its reutilisation or recycling.

In the systems described above, the joining elements are usually independent of the system itself (mortar, screws, special anchoring pieces, etc.), which means that while they might be ideal for a specific type of material constituting the panel or the structure, the same joining element or system may not be suitable for another panel in a different material. Thus a certain degree of incompatibility ensues.

SUMMARY OF THE INVENTION

The drawbacks described above concerning the current state of the art are overcome through use of the principles on which this invention is based.

The system consists basically in providing the panels to be assembled with configurations for their joining or assemblage with other panels of similar conception, said configurations having a special shape which allows their quick assembly and coupling thereby constituting a system of compatible elements. Said configurations are advantageously integral with the panel body which is obtained by molding of any material or forming of a metal or plastic plate or of a plate made of another malleable material.

Any material can be used for the panels, since the particularity of the system is determined by adjustment to given forms and dimensions.

The proposed panel is thus provided with mortise-and-tenon coupling means on the basis of protuberances (tenons, projections or protrusions) arranged on one or more faces of the panel or panels to be assembled and operable to interconnect by coupling into recesses (pockets, hollows or cavities) defined in corresponding opposite portions of the face or faces of another panel.

The coupling ensures that the parts remain perfectly joined in general by nesting (in particular by force fitting, at least one of the two members of the connection having for such a purpose been made resilient), aligned and anchored, while the projections permit the parts to remain separate from each other, leaving an interstitial gap free which can be implemented or used to accommodate facilities; the protuberances being besides distributed on the panel face at such a distance that they leave an interstitial gap free which can be implemented or not or can be used to accommodate facilities in any direction.

The parts can be as well joined by mere nesting and with the aid of a binding means, for example.

The system differentiates between one side and its opposite; they are therefore independent from each other and each side and its facing can be given its own industrial treatment. Thus the panel is assembled on site in a completely finished state. Similarly, the panel can be assembled or dismantled very easily and as often as required, without the need for any additional type of joining element: it is sufficient to apply a lever to one of its ends.

The panel to be used to carry out a surface such as a facing, floor, roof, partition etc. of a building or a wall of a construction according to this invention is essentially characterised in that it comprises a plate provided on at least one of its faces with a series of tenon and/or mortice couplings in form of protuberances and recesses of any adequate configuration (cylindrical, frustoconical, etc.), at least one of the walls of said protuberances or recesses being resilient and thus facilitating the snug force fit between them when conveniently opposing the faces of two panels, the height of said protuberances being such that it determines a separation between the opposite faces of the two panels which forms the said cavity, said protuberances and recesses being distributed at such a distance that they offer interstitial gaps through the free hollow space between panels.

The system needs no structural support elements, although where the panel is required to be fixed in a given position, the placing of fixing guides on its perimeter will suffice.

Since no intermediary joining elements are needed, the panels can be of any desired dimensions, with a minimum fixed by the base module, which by way of an example might be 5×5 cm.

The panels may be arranged either horizontally, vertically or sloping, without the arrangement of one side conditioning that of its opposite or the initial arrangement conditioning future ones.

The system is assembled dry, thus preventing the appearance of damp and facilitating execution, since no specific knowledge is required of joining elements.

Since the panels can be thoroughly industrialised, any surface facing, formal finishing or dimensioning can be carried out with greater precision in the most suitable conditions and using the most suitable materials by different industries and applying different technologies. Moreover, the assembly and adjustment of the panels does not depend on the skill of the fitter, since these are determined by the coupling system itself.

The assembly of the panels determines the appearance of inner gaps between both faces, allowing the passage of installations in several directions. Furthermore, the dimensions of these gaps can be varied according to the dimensions (essentially height) of the coupling means, projection or tenon used.

Likewise, depending on the dimensions of the projection, the thickness of the side and the characteristics of the base material, it is possible to obtain a wide variety of wall thicknesses as well as adaptability of the panel to the characteristics stipulated by the regulations or required by the compartmented space.

Besides its basic application as a partition element, the system can also employed in floors, ceilings, facades, roofs and so on.

In the case of floors, the system allows to install heating conduits or other installations and to easily provide access ports for the same. The arrangement of projections every few centimeters permits that the paving material does not have to be too rigid.

The system makes it possible for facades to be ventilated internally, thus minimising thermal gradients, which are so damaging to the external exposed element. Furthermore, humidity is eliminated through the interstitial gaps.

Given that the external facade elements may be as small as the minimal module, that they need not necessarily be fixed on their perimeters and that the joins between them need not be closed, there is ample room for their expansion and contraction movements. Consequently, there is no generation of additional stress, which is difficult to quantify and, in most cases, the cause either of detachment or the appearance of cracks.

In the case of this system, the possibility of expansion is determined by the flexibility of the base material used for the coupling and by the dimensions of the parts and their joints.

The system allows for internal ventilation of roofs, with the same advantages as those described for facades.

The system can also be applied in rehabilitation and alteration operations on existing walls, so that with a minimal loss of space (the thickness of the panel) easy assembly and dismantling of facing and passage of installations are obtained, both for walls and for floors and ceilings.

The system can also be used as the background for stage sets, display windows and stands, cases in which minimal assembly time and the possibility of reutilisation are of crucial importance.

Thanks to this system, panels can be hung from or raised on guides, so that they need neither reach the ceiling nor touch the floor. It is also possible to obtain freestanding panels in the form of mobile screens through the suitable arrangement of corner panels. By using struts, the panels can be placed entirely separate from any structural support, without the need for guides. They can even be assembled as panels that slide in two perpendicular directions.

An interior guide can be placed in the hollows formed by the panels, so that the interstitial space remains free and the frame of the hollow is kept rigid, acting as a support for further elements of carpentry.

DETAILED DESCRIPTION OF THE DRAWINGS

The foregoing will be further explained in conjunction with the following detailed description and drawings, which show and describe several embodiments of the invention, and which are not intended to limit the scope of the invention, which is defined in the appended claims.

FIG. 5A is a side elevational view of a U-shaped guide for fixing the panels of the present invention;

Figure 6A:
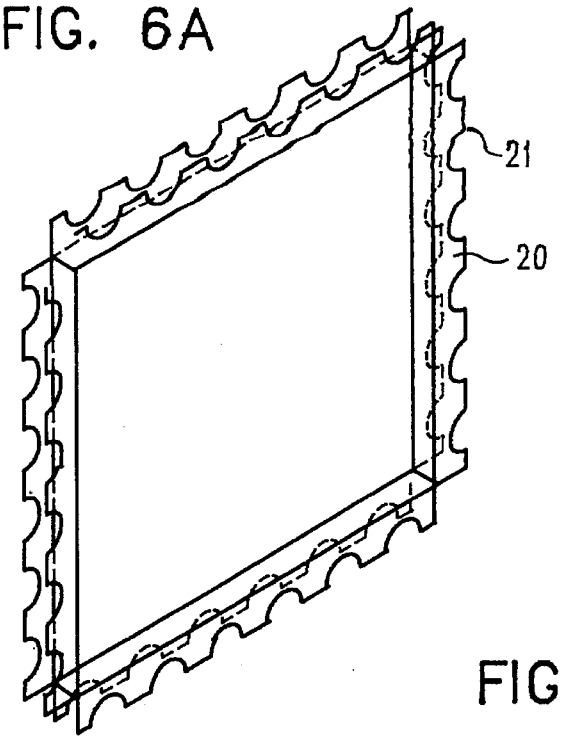
Figure 6B:
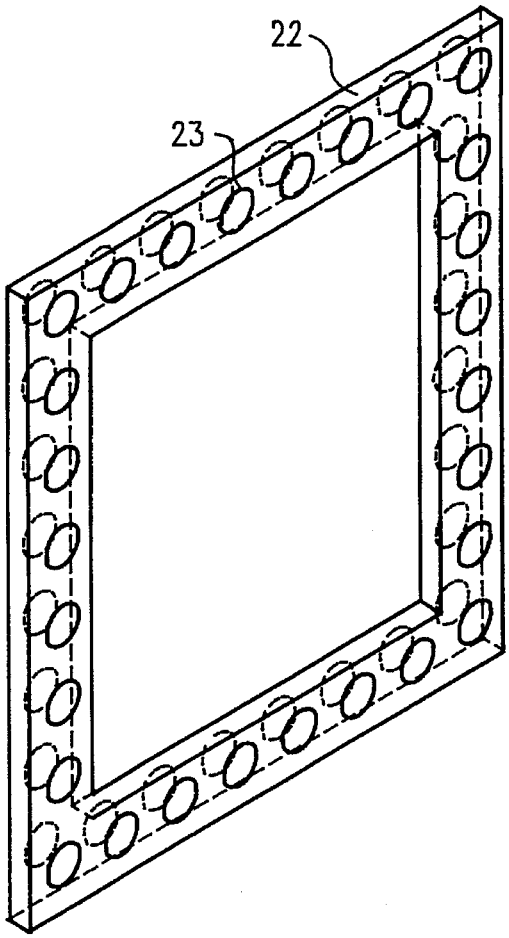
Figure 7A:
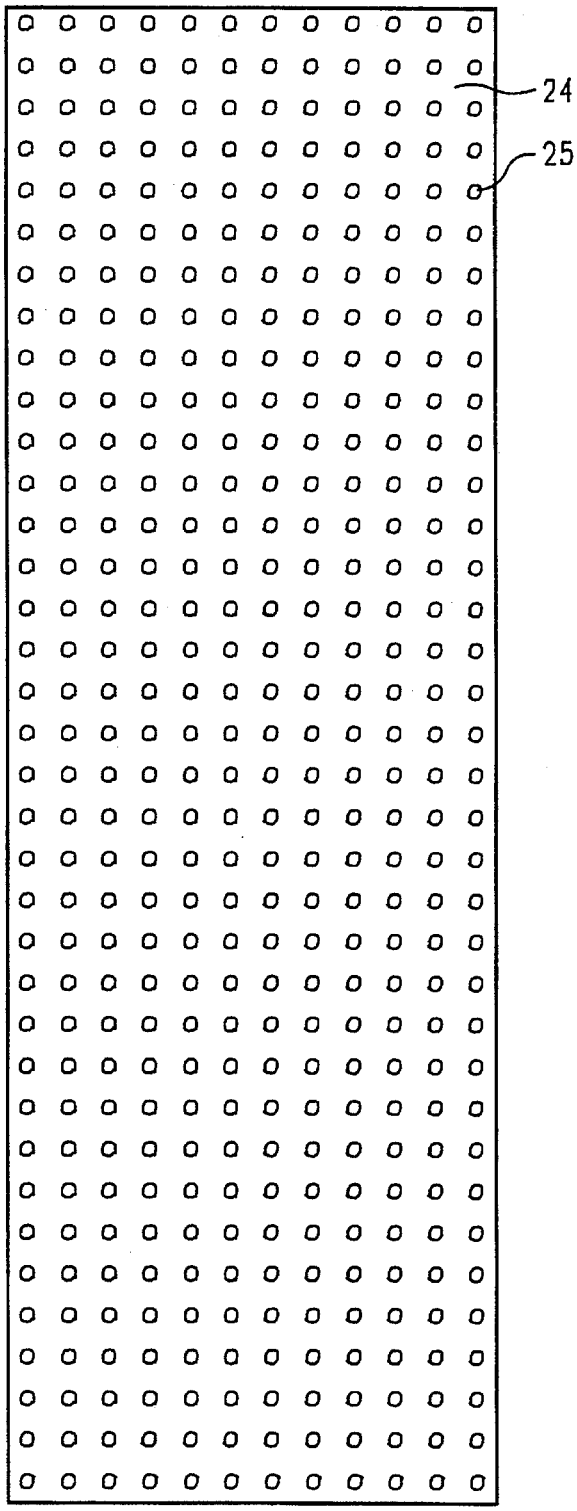
Figure 7B:
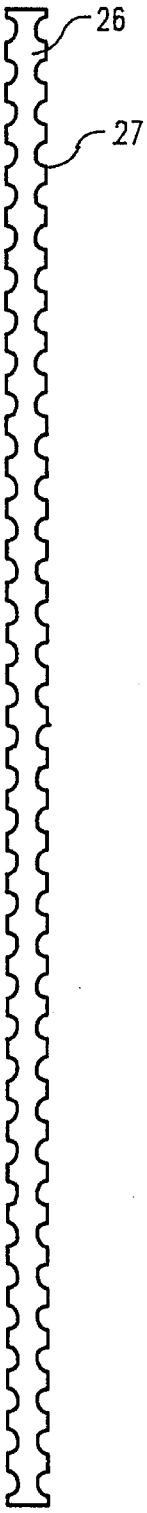
Figure 7C:
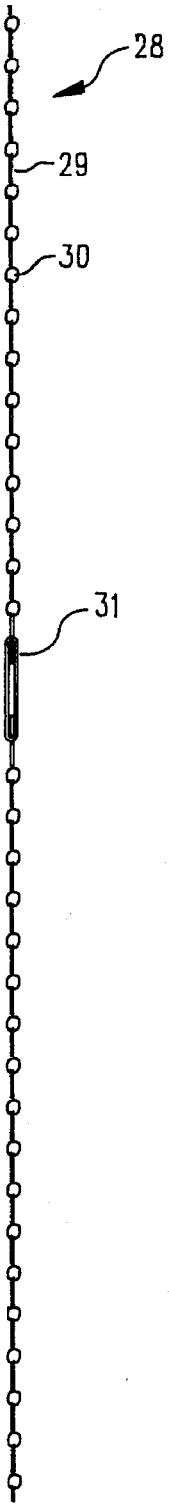
Figure 8A:
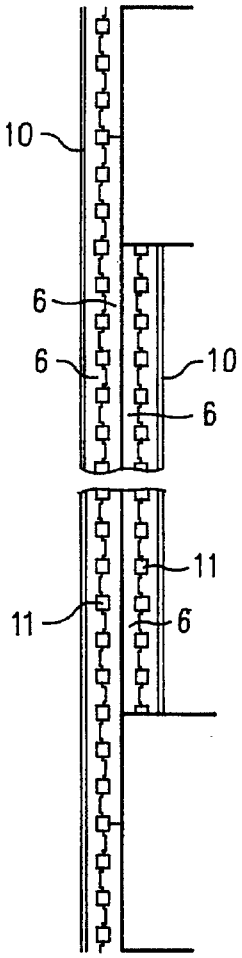
Figure 8B:
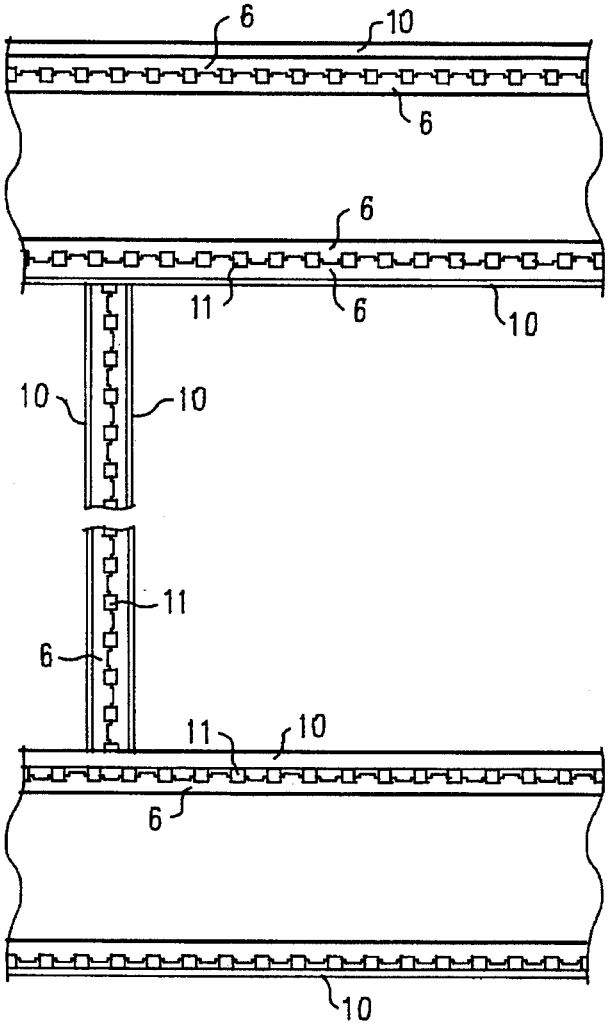
Figure 9A:
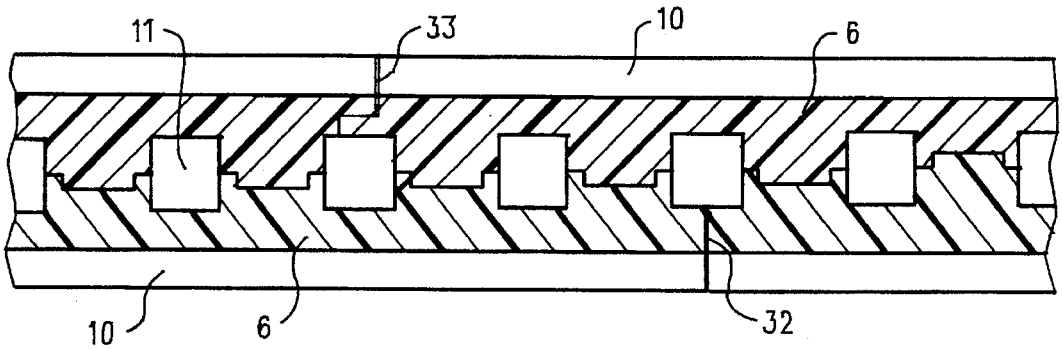
Figure 9B:
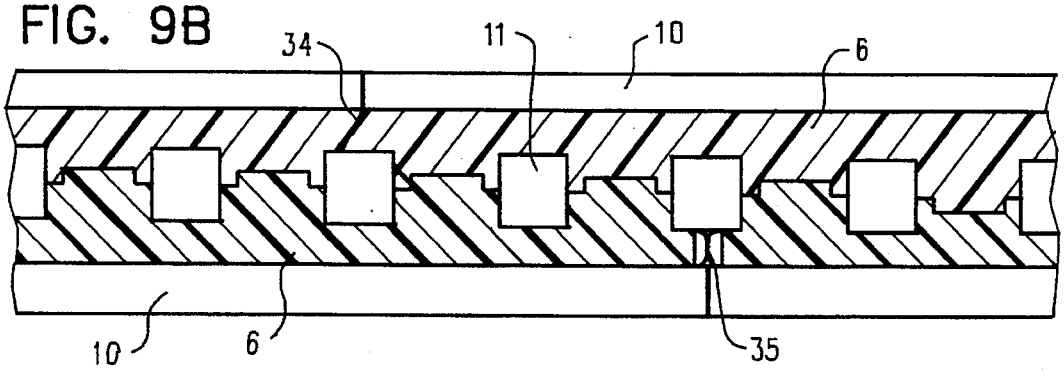

FIG. 5B a perspective view of the guide of FIG. 5A;

FIG. 5C is a side elevational view of a second embodiment of a guide for fixing the panels of the present invention;

FIG. 5D is a perspective view of the guide of FIG. 5C;

FIG. 6A is a perspective view of a frame employed with the panels of the present invention;

FIG. 6B is a second embodiment of a frame employed with the panels of the present invention;

FIG. 7A is a plan view of a perforated plate attachable to the panels of the present invention;

FIG. 7B is an elevational view of a guide rib attachable to the panels of the present invention;

FIG. 7C is an elevational view of a strut attachable to the panels of the present invention;

FIG. 8A is a vertical section showing the panels of the present invention employed on facades;

FIG. 8B is a vertical section showing the panels of the present invention employed on a floor and ceiling;

FIG. 9A is a sectional view showing the attachment between two panels of the present invention; and FIG. 9B is a sectional view illustrating an alternative type of attachment of the panels of the present invention.

DETAILED DESCRIPTION OF THE PREFERRED EMBODIMENTS

Figure 1A:
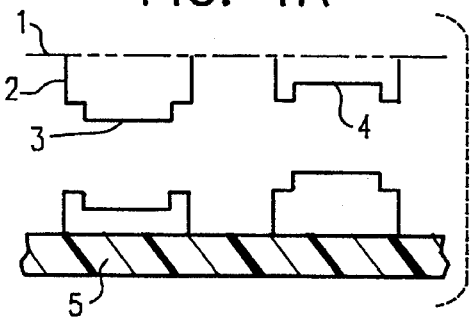
FIG. 1A is a sectional view of a sheet-type panel of the present invention.

FIG. 1A is a sectional view of a sheet-type panel showing the sheet-type panel base 1 itself with a projecting portion 2 followed by a protuberance or tenon coupling 3 and also with an adjacent mortise coupling 4 on one of its faces. Opposite to said panel there is a similar second panel with a panelled facing 5 on the sheet.

Figure 1B:
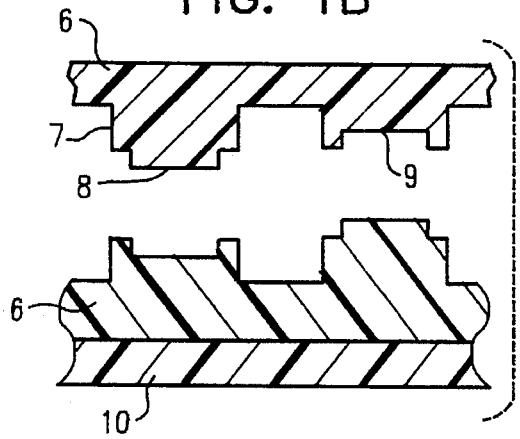
FIG. 1B is a sectional view of a solid-type panel of the present invention.

FIG. 1B is a sectional view of a solid-type panel consisting of a plate-type straight panel base 6, a projecting portion 7 ending in a protuberance or tenon coupling 8 and an adjacent mortise coupling 9. Opposite to said panel there is a similar second panel 6 with a facing 10.

Figure 1C:
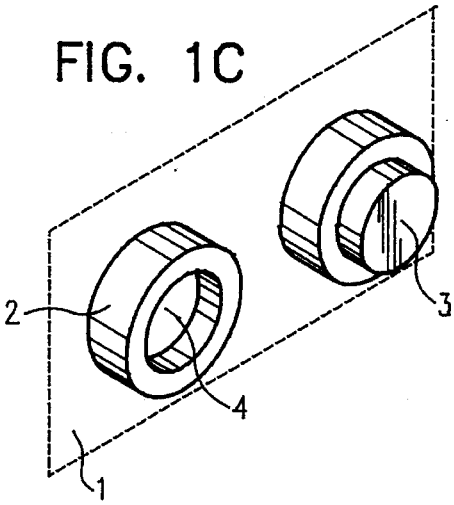
FIG. 1C is a perspective view of the sheet-type panel of FIG. 1B.

FIG. 1C is an axonometric perspective view of the sheet-type panel illustrated at the top of FIG. 1A with the same numerals.

Figure 1D:
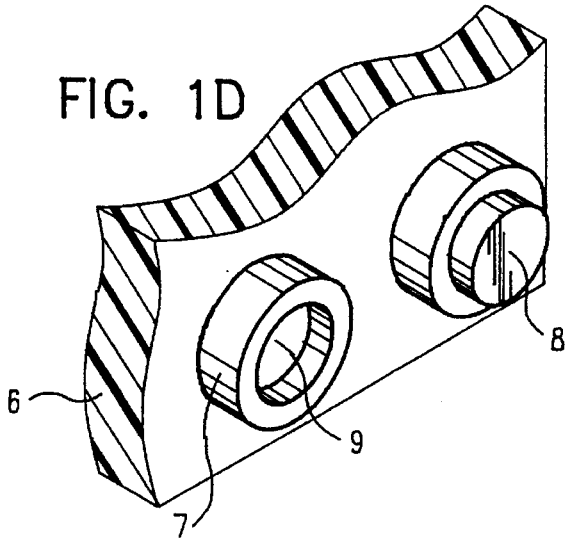
FIG. 1D is a perspective view of the solid-type panel of FIG. 1B.

FIG. 1D is an axonometric perspective view of the solid panel at the top of FIG. 1B with the same numerals.

Figure 2A:
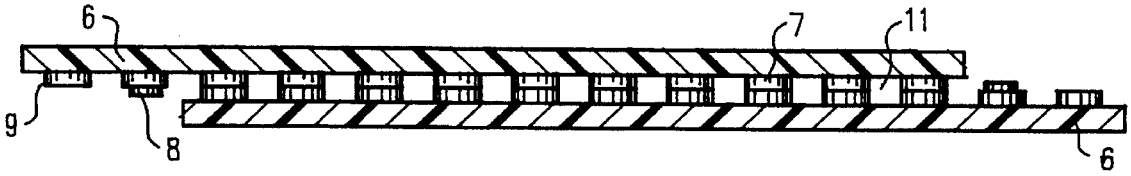
FIG. 2A is a cross-sectional view of two panels of the present invention that have been coupled.

FIG. 2A is a cross-sectional view of two operatively coupled panels through the interstitial gap showing the plate-type straight panel bases 6, the projections 7, the tenon couplings 8 and the interstitial gaps 11 which are transversal to the section line.

Figure 2B:
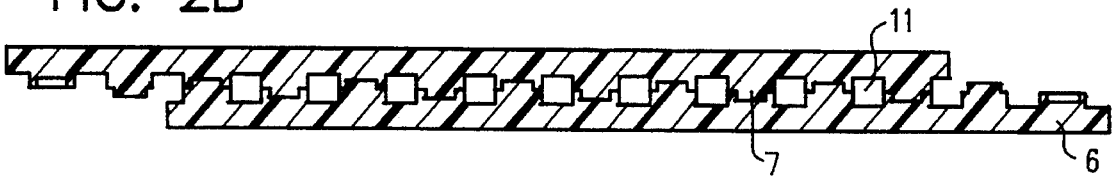
FIG. 2B is a cross-sectional view of two panels of the present invention that have been coupled, taken through the coupled projections thereof.

FIG. 2B is a sectional view similar to the previous one, though in this case the panels 6 have been sectioned through the projections 7; whereby we can observe the interstitial gaps 11 and the coupling between panels.

Figure 2C:
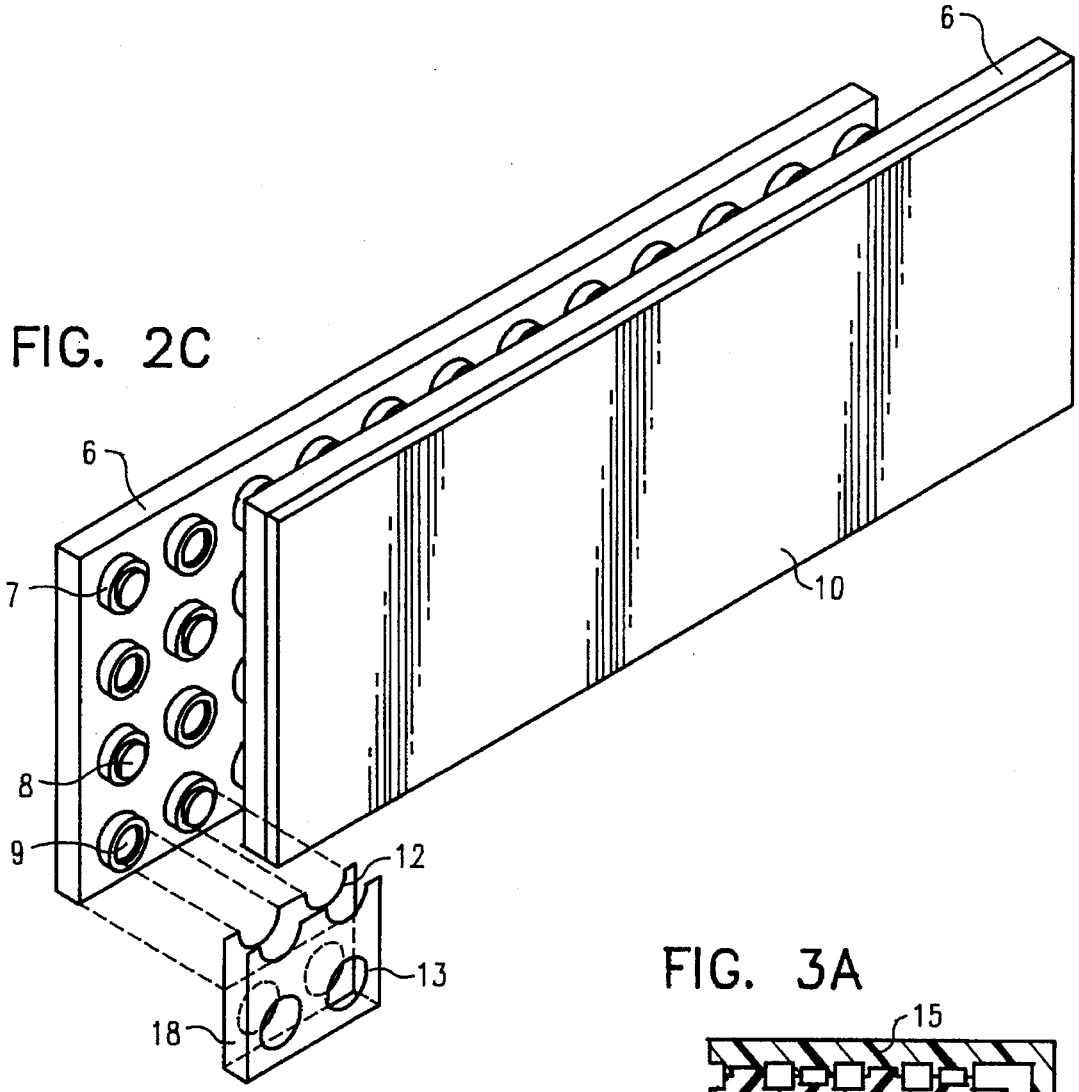
FIG. 2C is a perspective view of the two panels of FIG. 2B of the present invention that have been coupled.

FIG. 2C is an axonometric perspective view of two panels 6 operatively coupled by insertion of the tenon couplings 8 into the mortise couplings 9 of two opposite panels. Part 18 is a fixing guide, and in this case said guide is placed on the floor and on its equispaced upper recesses 12 will be placed the panels 6 of both sides, with their projections 7 being arranged through said recesses 12. The guide fits into the interstitial gap thus preventing the displacement of panels 6. The round opening 13 of guide 18 is used for nesting in it a part for fixing a socle ending the wall or partition. If fixed to the roof, this guide 18 would allow to hang the panels from it by arranging the projections 7 through its openings 13.

Figure 3A:
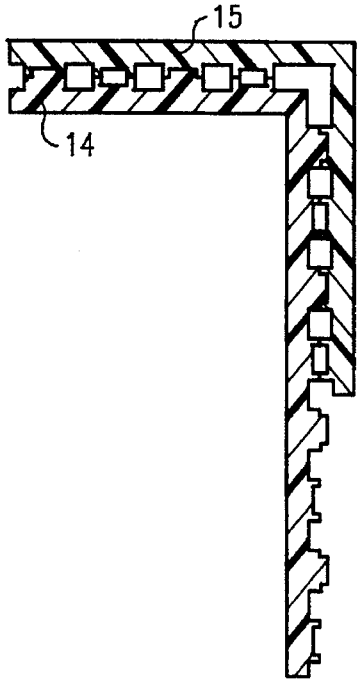
FIG. 3A is a cross-sectional view of two panels of the present invention that have been coupled at a right angled corner.

FIG. 3A is a sectional view showing an example of a corner encounter between two panels 14 in "L" and 15 in "V", showing the interconnection between their protrusions and recesses.

Figure 3B:
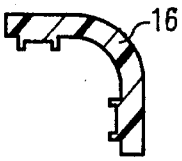
FIG. 3B is a cross-sectional view of a curved corner panel of the present invention.

FIG. 3B shows in a sectional view a curved exterior corner profile 16.

Figure 3D:
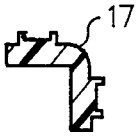
FIG. 3D is a cross-sectional view of an angled interior panel of the present invention.
Figure 3D:
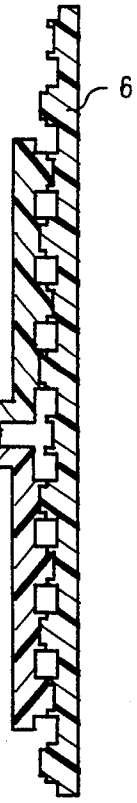
Figure 3C:
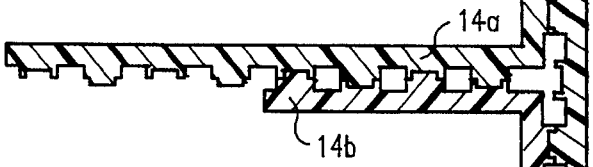
FIG. 3C is a cross-sectional view of a T-shaped coupling of two panels of the present invention.

FIG. 3C is an example of a T-shaped encounter between two panels **14*a* and 14*b* in "L" with a conventional panel 6, in accordance with the invention represented in a sectional view FIG. 3D shows in cross section an angled interior profile 17**.

Figure 4:
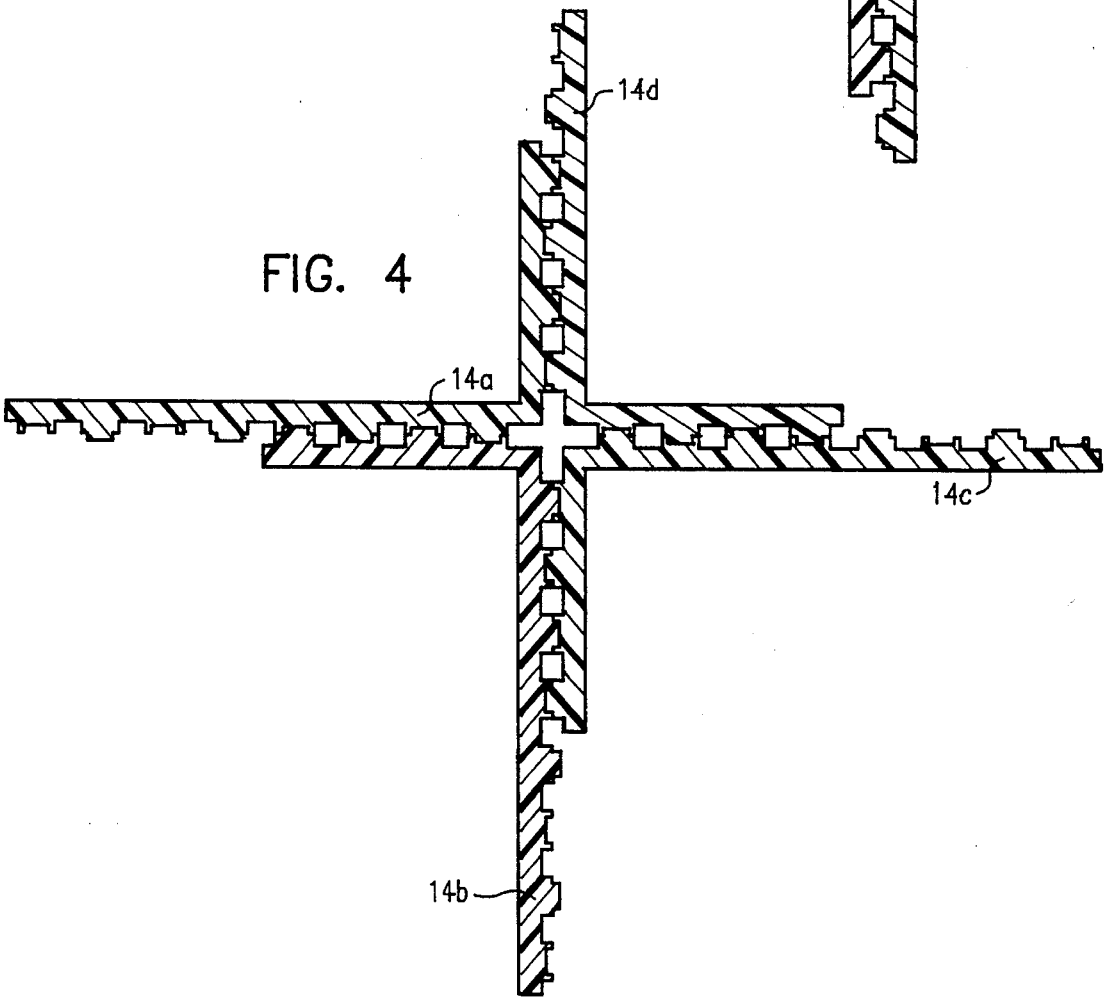
FIG. 4 is a sectional view of four corner panels of the present invention forming an X configuration.

FIG. 4 illustrates in a sectional view an example of an encounter in the form of an "X" between panels in "L" **14*a*, 4*b*, 14*c* and 14*d***.

FIG. 5A shows a side elevational view of a simple guide in U-shape for fixing the panels, with a series of recesses 12 along the edges of its flanges.

FIG. 5B is an axonometric perspective view of the simple guide 19 of the previous Figure showing how said recesses 12 are directly opposite in twos.

FIG. 5C is a side elevational view of a guide 18 for the fixing of panels like the one shown in FIG. 2C, provided with recesses 12 and round openings 13, shown in perspective in the FIG. 5D.

FIG. 6A is an axonometric perspective view of a frame which is used in accordance with the invention for forming hollows in the walls, roofs, floors, middle walls or partitions defined by the panels being described, with sills 20 having on the outside a series of equispaced recesses 21 which allow to arrange through them the protuberances between panels. Said frame covers the interstitial gap, allows the fitting of carpentry and fixes the panels to each other.

FIG. 6B shows in a similar view a second type of frame similar to the previous one but whose sills 22 integrate a series of equispaced round through openings 23 provided for arranging through them the interpanel joining protuberances. Said sills 22 with openings 23 fulfill the tasks mentioned in connection with the previous Figure and rigidize the hollow.

FIG. 7A is a plan-view of a simple perforated plate 24 comprising a plurality of holes 25 allowing the coupling of panels by insertion of their protuberances into said holes without letting pass the projections. This plate can be used to place it as the base of a table for machining the panels. The plate can also be used to fix panels by one only side. If both sides were coupled, it will give the assembly the physical characteristics of the plate, such as for example a bigger weight, more rigidity, the possibility of curved walls or of walls at different angles, etc.

FIG. 7B is an elevational view of a part or interstitial guide 26 between panels. Said part 26, whose edges present a double row of recesses 27, can be solid or hollow and can be placed in the interstitial gap in order to give more rigidity to the panel or by way of flashing, etc.

FIG. 7C is an elevational view of a panel fixing strut 28 allowing the panels' movability and including a cable 29 provided with a chain of balls 30 which are dimensioned so that they fit with minimum allowance in the interstitial gaps 11 between panels, allowing for example the sliding of the panel, said cable strut integrating a tensile ironwork 31.

FIG. 8A is a vertical section exemplifying the arrangement of panels 6 according to the invention with and without facing 10 in accordance with the invention on facades and also showing the interstitial gaps 11 between panels.

FIG. 8B shows another vertical section exemplifying the arrangement of panels 6 according to the invention with facing 10 according to the invention in floor and ceiling.

FIG. 9A is a sectional view illustrating the perimetric encounter between panels 6 with outer facing 10, according to the invention, the opposed edges of said panels 6 having a straight 32 abutting profile at the bottom or a stepped 33 abutting profile at the top.

FIG. 9B is a view similar to the previous one but where the opposed edges of panels 6 have a bevelled abutting profile 34 at the top or include resilient joints 35 tightly sealing said abutting edge of panels 6 with outer facing 10.

I claim:

1. A prefabricated panel for buildings and constructions, comprising:

a plate with faces, said plate having on at least one of said faces projections, said projections having one of a recess and a protuberance alternatively thereon for mortise-and-tenon coupling of said panel with a second panel having mating projections thereon that include the other of a recess and a protuberance, at least one of said protuberances on said panel and mating protuberances on a second panel being comprised of a material more resilient than said projections to provide a removable interference fit between said panel and a second panel for disassembly of said panel and a second panel, said projections on said panel and projections on a second panel defining a hollow space of a predetermined configuration between said panel and a second panel.

2. The panel of claim 1 further comprising:

frame means adjacent edges of said panel, said frame means having openings therein through which said projections of said panel adjacent said frame means pass.

3. The panel of claim 2 wherein said openings of said frame means are circular.

4. The panel of claim 2 wherein said openings of said frame means are semi-circular.

5. The panel of claim 2 wherein said frame means is a rectangle.

6. The panel of claim 2 wherein said frame means is linear.

7. The panel of claim 2 wherein said frame means is substantially U-shaped in cross-section with a base and two legs, said openings of said frame means being located in said legs so that projections of a different one of said panels can pass through each of said legs to frame two of said panels.

8. The panel of claim 1 wherein only one face has projections thereon.

9. The panel of claim 1 further comprising adhesive securing said protuberances of said panel to mating recesses of a second panel.

10. The panel of claim 1 wherein said panel is integrally formed.

11. The panel of claim 1 further comprising:

a plate having a plurality of circular openings therein, said plate adapted to be oriented parallel with one of said faces of said panel with said projections of said panel passing through said openings.

12. The panel of claim 1 further comprising:

a longitudinal rib having a plurality of semicircular openings therein, said rib adapted to be oriented parallel with one of said faces of said panel with said projections of said panel passing through said openings.

13. A prefabricated panel for buildings and constructions, comprising:

a plate with faces, said plate having on at least one of said faces projections, said projections having one of a recess and a protuberance alternatively thereon for mortise-and-tenon coupling of said panel with a second panel having mating projections thereon that include the other of a recess and a protuberance, at least one of said protuberances on said panel and mating protuberances on a second panel being comprised of a material more resilient than said projections to provide a removable interference fit between said panel and a second panel for disassembly of said panel and a second panel, said projections on said panel and projections on a second panel defining a hollow space of a predetermined configuration between said panel and a second panel; and frame means adjacent edges of said panel, said frame means having openings therein through which said projections of said panel adjacent said frame means pass.

14. The panel of claim 13 wherein said openings of said frame means are circular.

15. The panel of claim 13 wherein said openings of said frame means are semi-circular.

16. The panel of claim 13 wherein said frame means is a rectangle.

17. The panel of claim 13 wherein said frame means is linear.

18. The panel of claim 13 wherein said frame means is substantially U-shaped in cross-section with a base and two legs, said openings of said frame means being located in said legs so that projections of a different one of said panels can pass through each of said legs to frame two of said panels.

19. The panel of claim 13 wherein only one face has projections thereon.

20. The panel of claim 13 further comprising adhesive securing said protuberances of said panel to mating recesses of a second panel.

21. The panel of claim 13 wherein said panel is integrally formed.

22. The panel of claim 13 further comprising:

a plate having a plurality of circular openings therein, said plate adapted to be oriented parallel with one of said faces of said panel with said projections of said panel passing through said openings.

23. The panel of claim 13 further comprising:

a longitudinal rib having a plurality of semicircular openings therein, said rib adapted to be oriented parallel with one of said faces of said panel with said projections of said panel passing through said openings.

* * * * *

UNITED STATES PATENT AND TRADEMARK OFFICE

CERTIFICATE OF CORRECTION

PATENT NO. : 5,566,519
DATED : October 22, 1996
INVENTOR(S) : Antonio Almaraz-Miera It is certified that error appears in the above-indentified patent and that said Letters Patent is hereby corrected as shown below:

On the title page item [75],

The inventor's street address should be changed from "Esculator" to --Escultor--.

Signed and Sealed this

Twenty-second Day of July, 1997

Bruce Lehman

*Attest:*

BRUCE LEHMAN

*Attesting Officer*

*Commissioner of Patents and Trademarks*